US006732625B1

(12) United States Patent
Boynton et al.

(10) Patent No.: US 6,732,625 B1
(45) Date of Patent: May 11, 2004

(54) EASILY ADJUSTED WEB SLITTER

(75) Inventors: Blane G. Boynton, Vancouver, WA (US); Richard M. Holbert, Washougal, WA (US); Robert F. Shinn, Camas, WA (US); William R. Miller, Portland, OR (US)

(73) Assignee: Tidland Corporation, Camas, WA (US)

( * ) Notice: Subject to any disclaimer, the term of this patent is extended or adjusted under 35 U.S.C. 154(b) by 0 days.

(21) Appl. No.: 09/560,216

(22) Filed: Apr. 28, 2000

(51) Int. Cl.[7] ..... B26D 1/24
(52) U.S. Cl. ..... 83/482; 83/500; 83/506
(58) Field of Search ..... 83/482, 500, 503, 83/506, 508.2, 508.1, 507, 501, 502, 497, 425, 433, 481

(56) References Cited

U.S. PATENT DOCUMENTS

| | | | | | |
|---|---|---|---|---|---|
| 3,186,282 | A | * | 6/1965 | Waterhouse | 83/497 |
| 3,788,781 | A | * | 1/1974 | McClocklin | 417/401 |
| 3,886,833 | A | * | 6/1975 | Gunn et al. | 83/499 |
| 3,892,156 | A | * | 7/1975 | Johnstone | 83/469 |
| 4,092,886 | A | * | 6/1978 | Nowisch | 83/56 |
| 4,257,299 | A | | 3/1981 | Aykut | |
| 4,274,319 | A | * | 6/1981 | Frye et al. | 83/430 |
| 4,380,945 | A | | 4/1983 | Guild et al. | |
| 4,474,096 | A | * | 10/1984 | Müller | 83/482 |
| 4,570,518 | A | * | 2/1986 | Burmeister et al. | 83/504 |
| 4,614,142 | A | * | 9/1986 | Fritz et al. | 83/496 |
| 4,676,133 | A | * | 6/1987 | Fujimura | 83/497 |
| 4,824,428 | A | | 4/1989 | Cavagna | |
| 4,876,933 | A | * | 10/1989 | Tahara | 83/482 |
| 4,905,554 | A | * | 3/1990 | Cavagna | 83/482 |
| 5,058,475 | A | | 10/1991 | Tidland et al. | |
| 5,083,489 | A | | 1/1992 | Tidland et al. | |
| 5,131,304 | A | * | 7/1992 | Paavola | 83/478 |
| 5,247,865 | A | * | 9/1993 | Kroger et al. | 83/482 |
| 5,370,026 | A | * | 12/1994 | Cavagna | 83/478 |
| 5,596,918 | A | | 1/1997 | Longwell et al. | |
| 5,735,184 | A | | 4/1998 | Miller et al. | |
| 6,012,377 | A | * | 1/2000 | Hung | 91/229 |

* cited by examiner

*Primary Examiner*—Kenneth E. Peterson
*Assistant Examiner*—Omar Flores-Sánchez
(74) *Attorney, Agent, or Firm*—Chernoff, Vilhauer, McClung & Stenzel

(57) ABSTRACT

A vertically adjustable web slitter is adapted to be supported by a track of a web-slitting machine, and comprising an input port adapted to receive pressurized fluid. Also, a control assembly is adapted to controllably transmit the pressurized fluid into any one of a set of first fluid passageways. A cylinder is adapted to receive the pressurized fluid from one of the first fluid passageways. A piston, having a first end and a second end, is set into the cylinder and is adapted to be driven within the cylinder by the pressurized fluid. Further, a set of actuators that are adapted to be driven by pressurized fluid are separated by the piston and cylinder from the set of first passageways. Finally, the piston defines at least one second fluid passageway extending from the first end to the second end. A first flexible hose connects each second fluid passageway to a first fluid passageway and a second flexible hose operatively connects each second fluid passageway to one of the actuators.

10 Claims, 11 Drawing Sheets

EASILY ADJUSTED WEB SLITTER

BACKGROUND OF THE INVENTION

The present invention relates to a web slitter for cutting an endless web.

A web-slitting machine or system typically employs a number of web-slitting assemblies to cut an endless moving web, such as a continuous roll of paper or other material, into a number of strips (equal to the number of web-slitting assemblies plus one). The web-slitting machine supports and permits the positional adjustment of the web-slitting assemblies, thereby permitting the machine to be configured to cut any one out of a wide variety of strip width sets.

Referring to FIGS. 1 and 2, a prior art web-slitting assembly 10 includes a web slitter 12 that overlaps with a lower knife 22, so that together they present a scissors-like action to a continuous web of material which is pulled through the assembly 10 by a drum or a take-up reel (not shown). The web slitter 12 includes an upper carriage 16, which is slideably movable along a support in the form of a transverse bar 14, and a blade holder 18 that includes a freely rotating disk-shaped blade 20. The lower knife 22, which may be in the form of a drum or roller that has a sharpened edge, is positioned on a supporting sleeve 24.

Referring to FIG. 2, the upper carriage 16 of web slitter 12 includes a brake shoe 26, which engages a dovetail-shaped projection 15 of the transverse bar 14. The brake shoe 26 may be operated pneumatically or by turning rotary brake knob 28. The transverse position of the carriage assembly 16 along the transverse bar 14 is adjusted by turning transverse control knob 30, which is connected to a shaft 32 (FIG. 2) which terminates in a pinion gear 34.

The upper carriage 16 is connected to the blade holder 18 by a dovetail-shaped guide key 38, which is selectively removable from the upper carriage 16. An added feature of this construction is that the blade holder assembly 18 may be reversed relative to the upper carriage 16 by merely sliding the blade holder assembly 18 off of the guide key 38, rotating it 180°, and sliding it back on, thus permitting either a right-hand or left-hand orientation.

A rotary control knob 52 provides mode control for the pneumatic systems, which power the locking of the upper carriage 16 to the transverse bar 14, the lowering of the blade holder assembly 18 toward the knife 22, and the shifting of the rotary blade 20 laterally toward the knife 22. More specifically, the control knob 52 permits an operator to command standby, setup or run mode. In standby mode, blade holder 18 is held at a raised and disengaged position. To function properly during run mode, the blade 20 and knife 22 must press against each other with a force that is within a proper range. If the force is too light or nonexistent, the web may not be slit. If the force is too great, the blade 20 may break. Accordingly, in run mode, blade holder 18 is not only lowered, but also moved to the side by a side-shift cylinder (not shown) having a maximum cylinder stroke distance. If carriage 16 has been correctly positioned on bar 14, this will cause blade 20 to contact and press against the knife 22 with an acceptable force. In setup mode, blade holder 18 is lowered and shifted to the side by the side-shift cylinder, thereby permitting an operator to move the web slitter 12 along the transverse bar 14 and to thereby place and press the blade 20 against the knife 22. By locking the carriage 16 in place at the resultant position the operator has readied web-slitting assembly 10 for run mode operation. However, the operator must exercise judgment and skill for the blade to press with an acceptable force against the knife 22 during run mode.

U.S. Pat. No. 5,058,475, referenced and incorporated above, simplifies the task of the operator by providing a "half-stroke" button. This button, when depressed, causes the side-shift cylinder to be stopped half-way through its stroke. During setup mode, an operator can depress the half-stroke button and move the web slitter 12 laterally along the transverse bar 14 so that the blade 20 contacts the lower knife and locks the carriage in place at the resultant location. After this, during run mode, the blade 20 will contact the knife 22 half-way through the stroke of the side-shift cylinder, with the remaining pneumatic pressure introduced into the side-shift cylinder pressing the blade against the knife 22. This "half-stroke" amount of force is approximately the optimum amount of force for the blade 20 to press against the knife 22. This innovation provided a definite advantage over the prior art of the time. Unfortunately, in practice it has been found that operators sometimes forgot to depress the "half-stroke" button during setup mode, thereby completely nullifying the affect of this button.

It is important in the design of web slitting machines that the shear or cant angle between the blade 20 and lower knife 22 be set precisely. The cant angle is the angular relationship between the blade 20 and the lower knife 22 in the plane of the blade 20 about a vertical axis. This angle must be set accurately so that the wear and deformation between the two cutting edges are kept to a minimum.

The need for accuracy in the setting of the cant angle complicates the performance of the following described reconfiguration of a web-slitting assembly. A blade 20 that is positioned to cut against a first edge of a knife 22 at a first cant angle will eventually wear away the first edge. It is then desirable to switch the relative positions of the blade 20 and the knife 22 so that the blade 20 makes contact with the knife's second edge, which is unworn. As shown in FIG. 1, the blades 20 are asymmetrically shaped to have a knife-contacting-side and a side that never contacts a knife 22. As a result, when it is desired to shift the blade arrangement so that the blade 20 contacts the knife 22 at the knife's second edge, it is necessary to reorient the blade 20 by about 180°. As noted earlier, a simple 180° rotation can be effected simply by sliding the blade holder 18 off of the guide key 38, rotating it 180°, and sliding it back on.

Unfortunately, the cant angle of the blade 20 also must be shifted to a mirror image angle of the first cant angle relative to a plane parallel with the faces of knife 22. Heretofore, there appears to have been no method for quickly and easily effecting this shifting of the cant angle, forcing the operator to make a time-consuming manual cant angle adjustment.

Another problem is encountered in that different makes of web-slitting machines have differently shaped bars (such as bar 14) for supporting web slitters. Heretofore, as a result, a web slitter had to be manufactured specifically to be accommodated by the bar shape of a particular make of web-slitting machine.

In addition, a problem is encountered in a system such as that of FIGS. 1 and 2 in which a removable blade holder 18 is supported by a piston that is housed in a cylinder (not shown) in the carriage 16 and that is driven down to engage the blade 20 with the knife 22 and driven up to disengage blade 20. If the blade holder 18 also includes one or more pneumatic actuators, the task of supplying these actuators with pneumatic pressure in the carriage 16 has typically been performed by a set of external hoses (not shown), each linking a source of pneumatic pressure to a receive port in the blade holder 18. The advantage of this arrangement is that the hoses circumvent the piston and accommodate the various distances between the carriage pneumatic pressure sources and the blade holder 18. A disadvantage of this arrangement, however, is that every time the blade holder 18 is replaced or reoriented, the hoses must be disconnected and reconnected. An additional disadvantage is that the hoses are exposed and therefore vulnerable to damage by operating personnel.

Yet another problem is encountered in a system, such as the one described above, in which a piston (not shown) moves the blade holder 18 up and down. When the piston is moved up, it creates a momentary drop in air pressure in the lower portion of its host cylinder. This drop in air pressure tends to draw the lint-filled air of the blade-slitting environment into the lower portion of the cylinder, thereby degrading system performance over time.

SUMMARY

The present invention is an improvement of the web slitter shown in the aforementioned U.S. Pat. No. 5,058,475 incorporated herein.

In one preferred aspect of the web slitter, a carriage and a blade holder are releasably and matingly interconnected by a connective assembly enabling selective reversal of the blade holder between opposing orientations about a vertical axis. A blade cant angle adjustment assembly enables a choice of either a first predetermined blade cant angle or a second predetermined blade cant angle, each adapted for a respective different one of the opposing blade holder orientations.

In another separate preferred aspect, a blade positioning assembly, in response to user selection of a setup mode, automatically moves the blade over only a predetermined partial portion of its maximum horizontal travel distance.

In another separate preferred aspect, the web slitter assembly is adapted to be fastened selectively to respective first and second web slitter tracks of different configurations.

In another separate preferred aspect, a first fluid passageway is located on one side of a piston which provides vertical adjustment of the blade. An enclosed second fluid passageway circumvents the piston to communicate between the first passageway and an actuator which moves in unison with the piston on the opposite side thereof.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
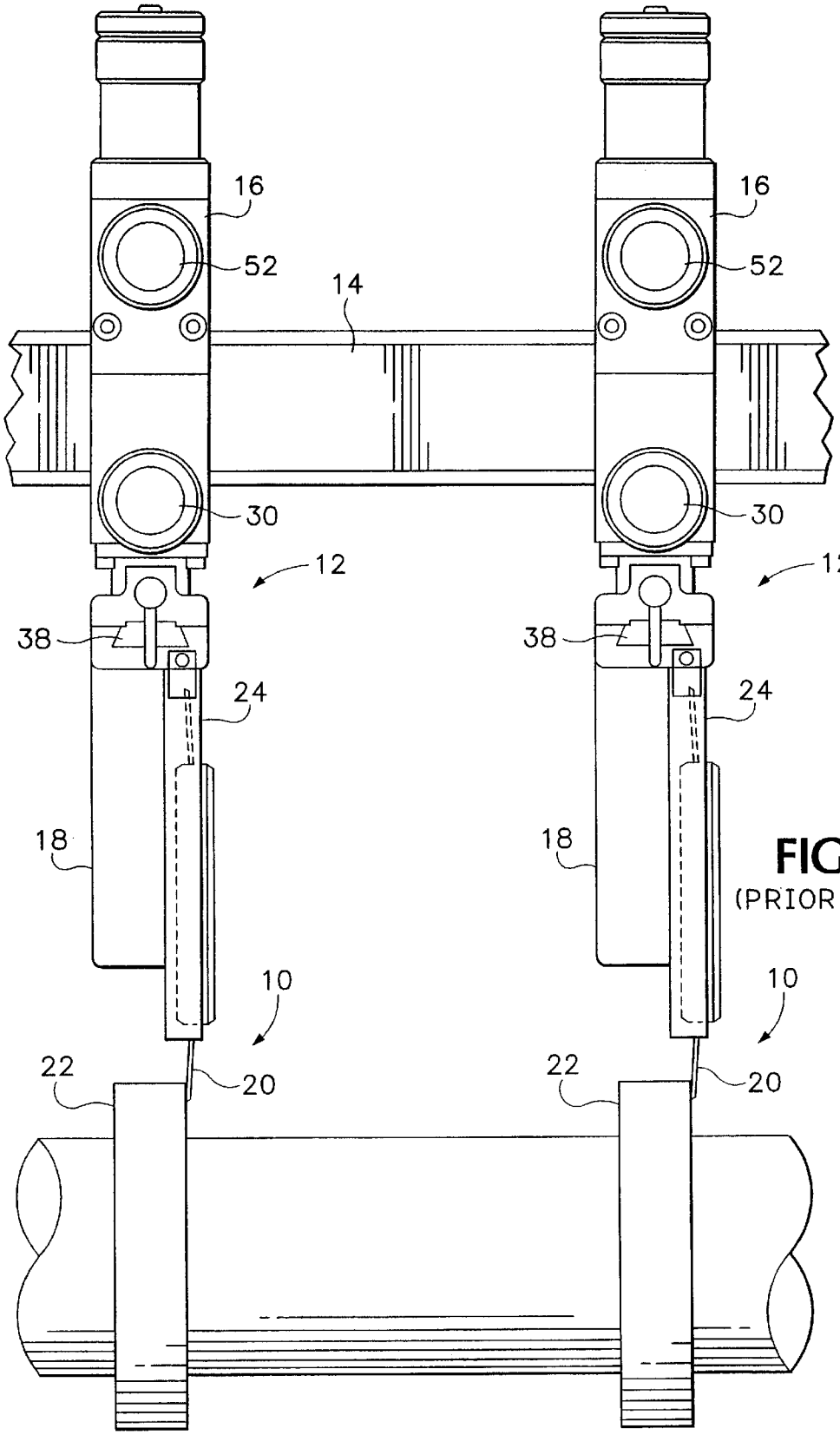
FIG.1 (PRIOR ART)
FIG. 1 is a front view of a portion of a prior art web slitting machine, showing two web slitting assemblies.
Figure 2:
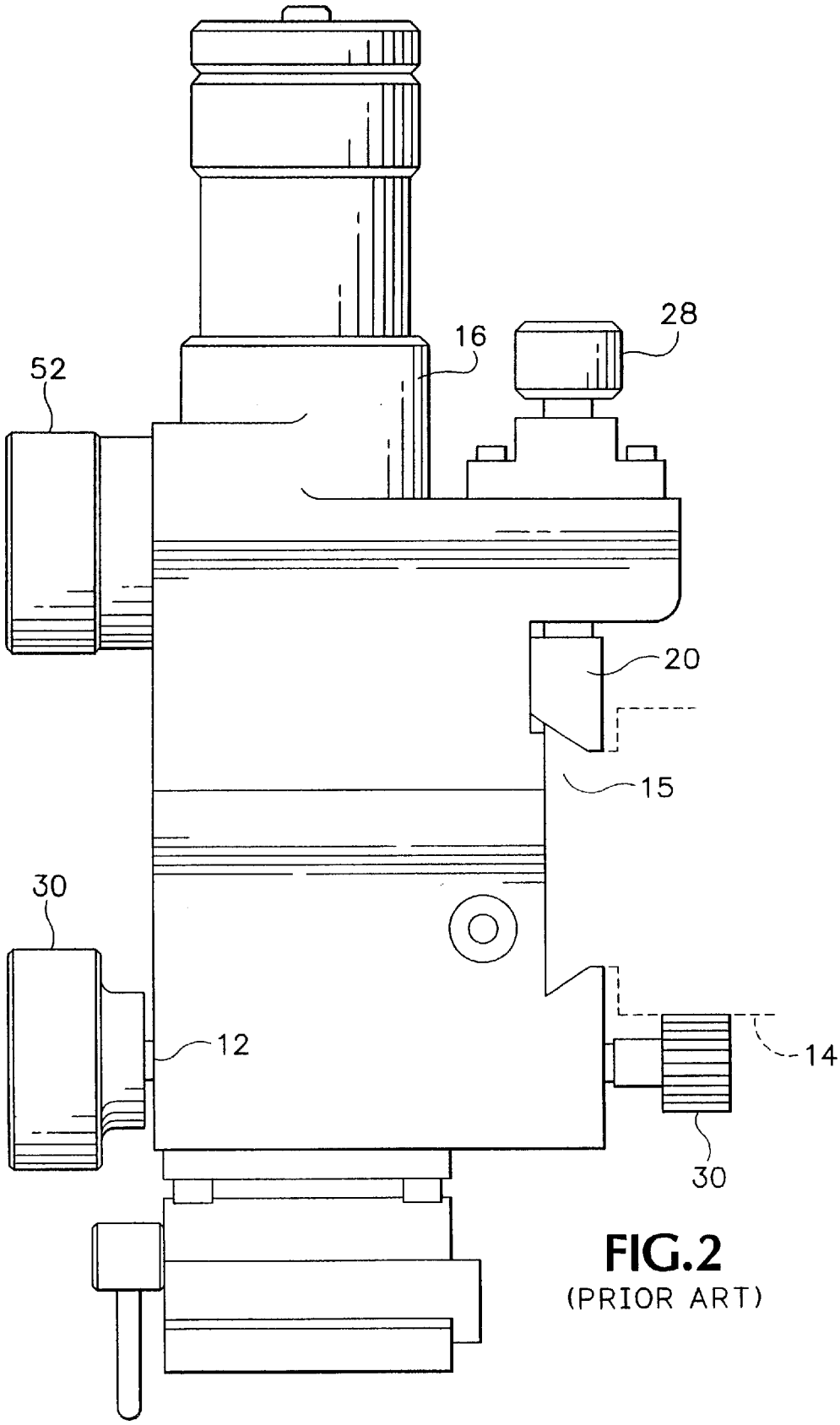
FIG.2 (PRIOR ART)
FIG. 2 is a side view of a carriage of the web slitting machine of FIG. 1.
Figure 3:
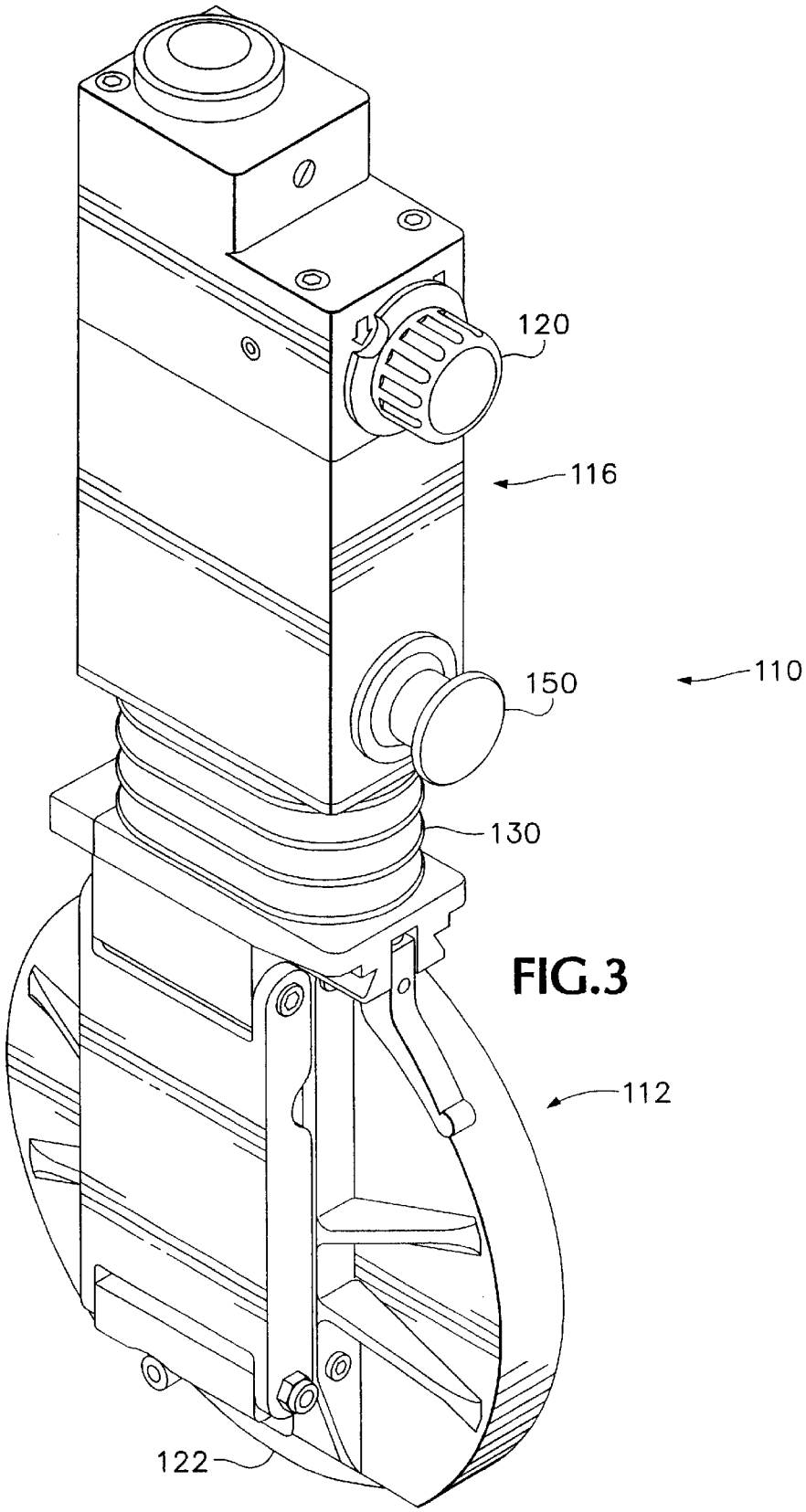
FIG. 3 is a perspective view of a web slitter according to the present invention.
Figure 5:
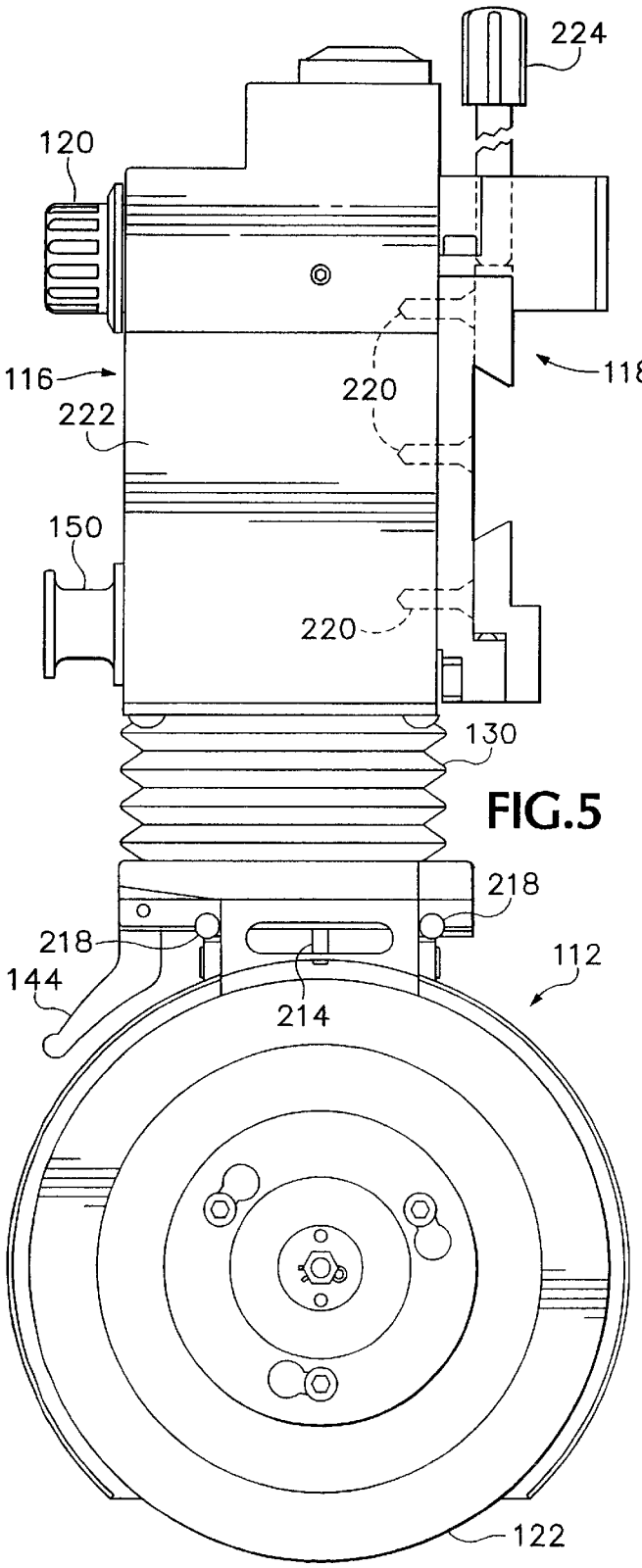
FIG. 5 is a side view of the web slitter of FIG. 3.
Figure 5A:
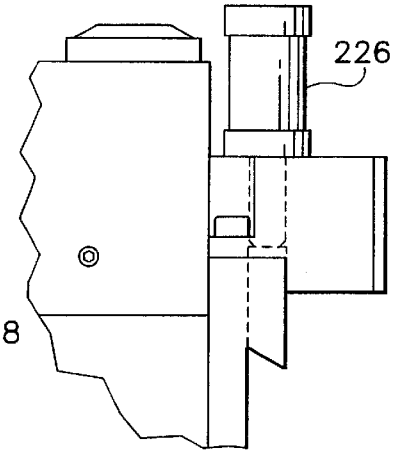
FIGS. 5A and 5B are partial side views of web slitters that represent alternative embodiments of the present invention.
Figure 5B:
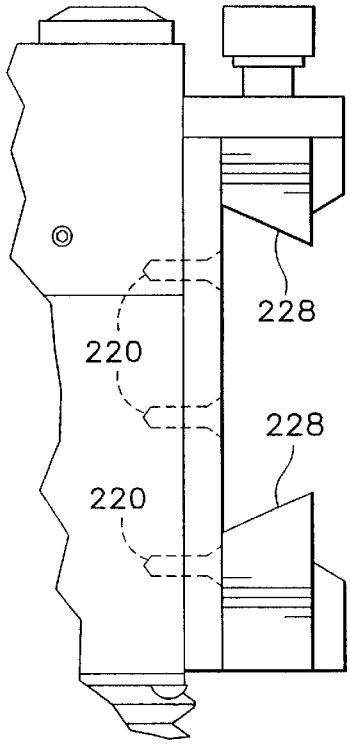

One preferred embodiment of a web slitter 110 according to the present invention includes a blade holder 112, supported by and depending downwardly from a carriage 116. In turn, carriage 116 has a bracket 118 (FIG. 5) for attaching to a support in the form of a dovetail-shaped transverse rail (not shown but similar or identical to rail 14 of FIG. 1). Bracket 118 is connected to the body of carriage 116 by a set of countersunk screws 220. A bolt 224 may be manually tightened to fasten bracket 118 to the rail. In an alternative embodiment, shown in FIG. 5A, a pneumatic actuator 226 is used to fasten bracket 118 to the rail. Referring to FIG. 5B, a second, alternative, bracket 228 may be attached to the body of carriage 116 to enable it to be fastened to a differently shaped rail, for example the rail of a competing web slitting machine manufacturer.

The blade holder 112 holds a circular blade 122 that engages with a lower knife 123 (FIGS. 9A and 9B) in order to slit a passing web. A blade positioning assembly that includes a control knob 120 permits an operator to command standby, setup or run mode. In standby mode, carriage 116 is shortened at an accordionized protective cover 130, so that blade holder 112 is held at a raised and disengaged position. In run mode, blade holder 112 is lowered and blade 122 is side-shifted, so that if correctly adjusted by an operator, it will contact and press against the lower knife 123 with an acceptable force. In setup mode, blade holder 112 is lowered and blade 122 is automatically side-shifted by half the run mode side shift distance. This permits an operator to move web slitter 110 laterally to place the blade 122 against the lower knife 123, lock the carriage 16 in place at the resultant position, and have confidence that during run mode, the blade 122 will press with an acceptable force against the lower knife 123.

Figure 8:
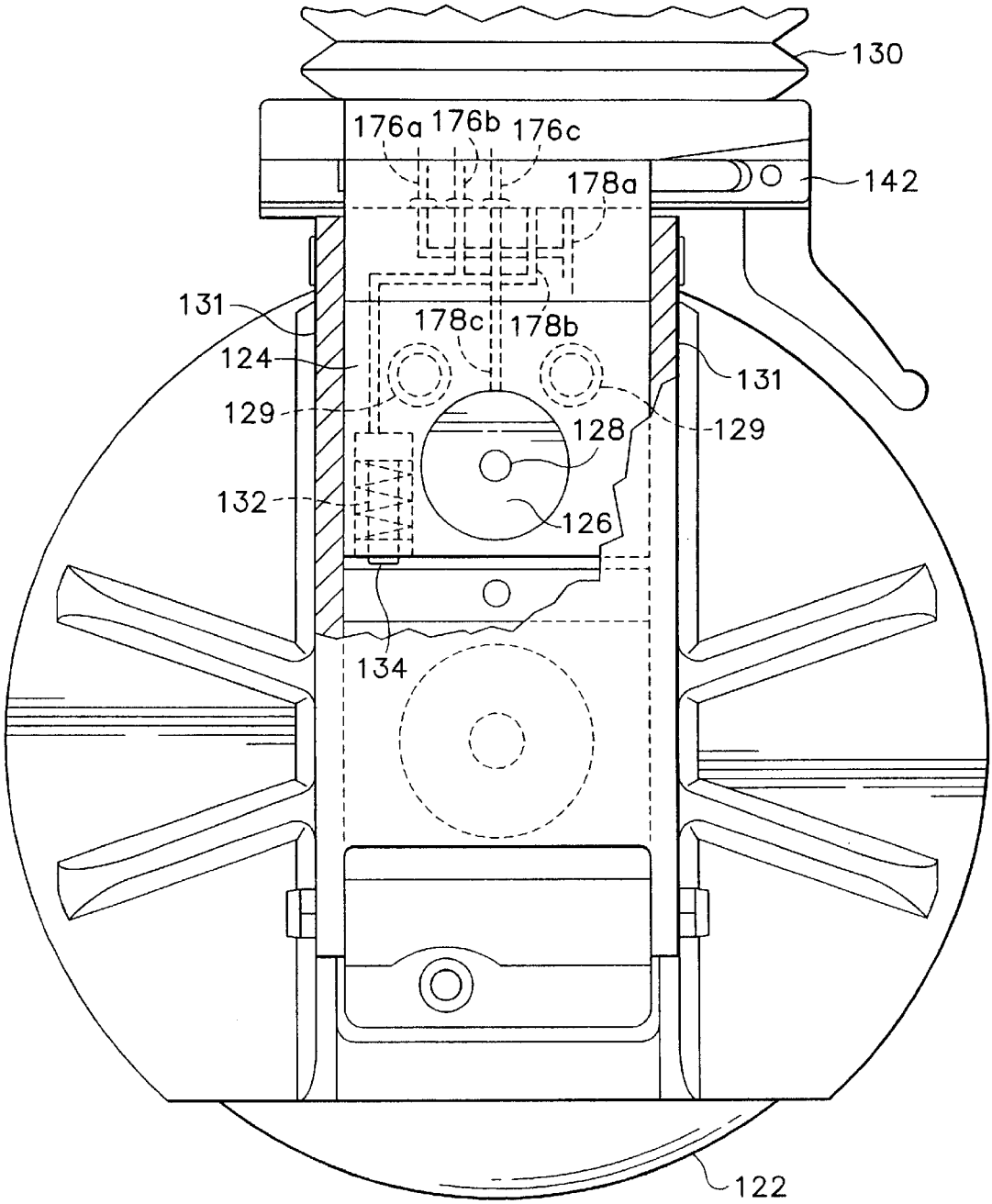
FIG. 8 is a cutaway side view of the blade holder portion of the web slitter of FIG. 3.
Figure 9A:
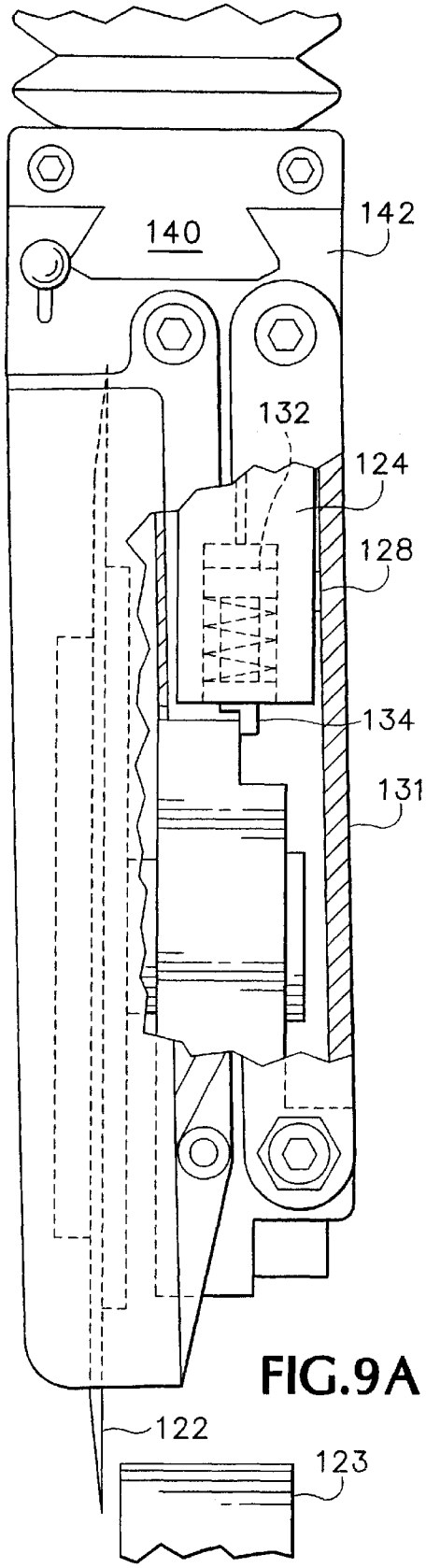
FIG. 9A is a cutaway front view of the blade holder portion of the web slitter of FIG. 3 as it appears in standby mode.
Figure 9B:
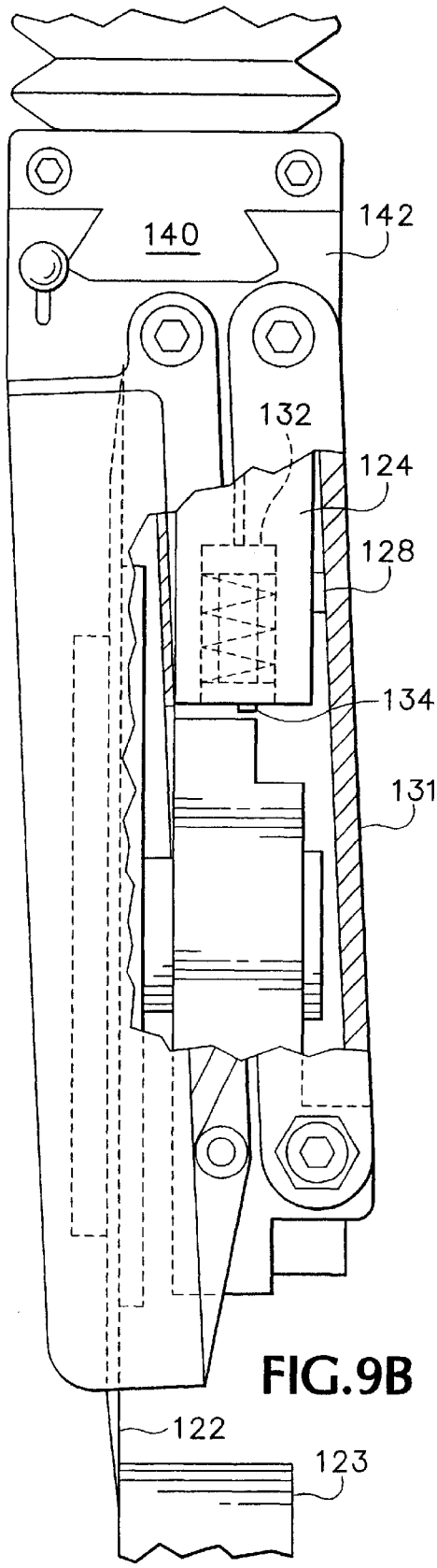
FIG. 9B is a cutaway front view of the blade holder portion of the web slitter of FIG. 3 as it appears in half-shifted mode.

Referring to FIGS. 8, 9A and 9B, the physical construction of the side-shift mechanism is as follows. Inside blade holder 112 there is a metal block 124, which is fixed in place relative to the top of blade holder 112. Set into block 124 is a side-shift cylinder 126 that pushes out a peg 128, which in turn pushes against a hinged parallelogram 131. A pair of springs 129 urge parallelogram 138 back into position when peg 128 is retracted. FIG. 9B shows peg 128 pushing parallelogram 131 to the right, which in turn shifts blade 122 to the right. Also resident in block 124 is a half-stroke actuator 132, which extends a notched arm 134. In standby mode (not shown) notched arm 134 is placed in its highest position and blade 122 is left in its unshifted standby mode position. During set-up mode, as shown in FIG. 9B, arm 134 is placed in its lowest position so that blade 122 is blocked after being shifted by one half the full stroke of side-shift cylinder 126. An operator can then slide carriage 116 until blade 122 contacts knife 123 and lock carriage 116 into place on mating transverse bar (not shown) at the resultant position. In run mode arm 134 is raised all the way, as it is in standby mode, and parallelogram 131 and blade 122 are shifted by cylinder 126 until the blade 122 encounters and is stopped by the knife 123, resulting in a good tension between the blade 122 and the knife 123.

Figure 4:
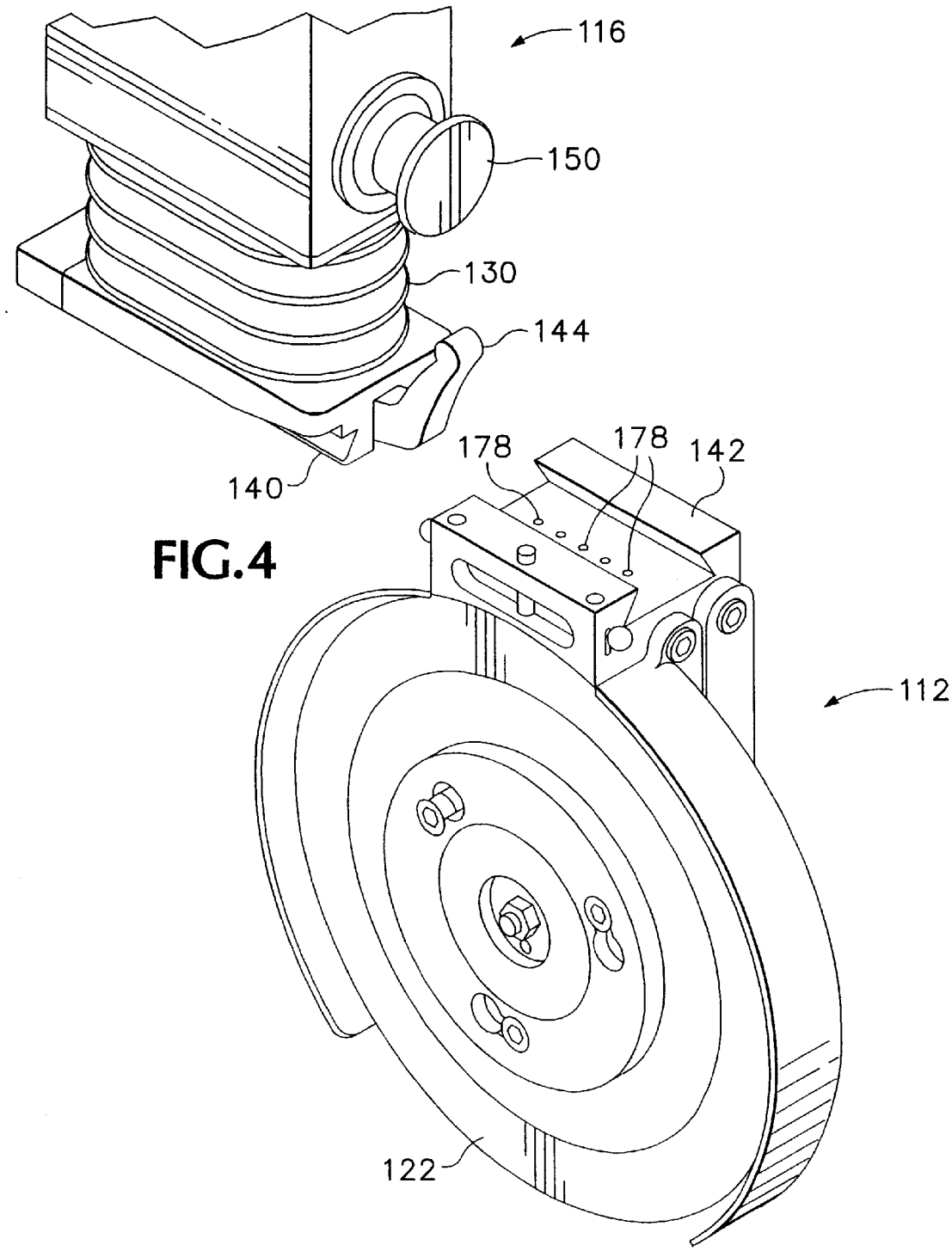
FIG. 4 is a perspective view of the web slitter of FIG. 3 in a state of partial disassembly.

As noted in the BACKGROUND OF THE INVENTION section, after a blade 122 has been in position contacting a first side of a knife 123, it is sometimes desirable to reconfigure the web-slitting machine so that so that the blade 122 contacts the second side of the knife 123. Because only one side of blade 122 is adapted to contact a knife 123, the operator must reorient blade holder 112 (and shift the position of the corresponding knife 123) in order to effect this reconfiguration. FIG. 4 shows a carriage-to-blade holder connector in the form of dovetail bar 140 protruding from carriage 116 that slidingly and matingly connects with a blade holder-to-carriage connector in the form of a dovetail bracket 142 positioned at the top of blade holder 112, facilitating the removal and reoriented reattachment of blade holder 112.

This is not all that is necessary, however, because the blade 122 must be canted slightly inwardly (relative to a vertical plane flush with the plane of the contacted side of the knife 123) toward the knife surface toward the contacted knife surface. If the blade were only rotated 180°, the blade 122 would be canted slightly outwardly and would not perform correctly.

Figure 6:
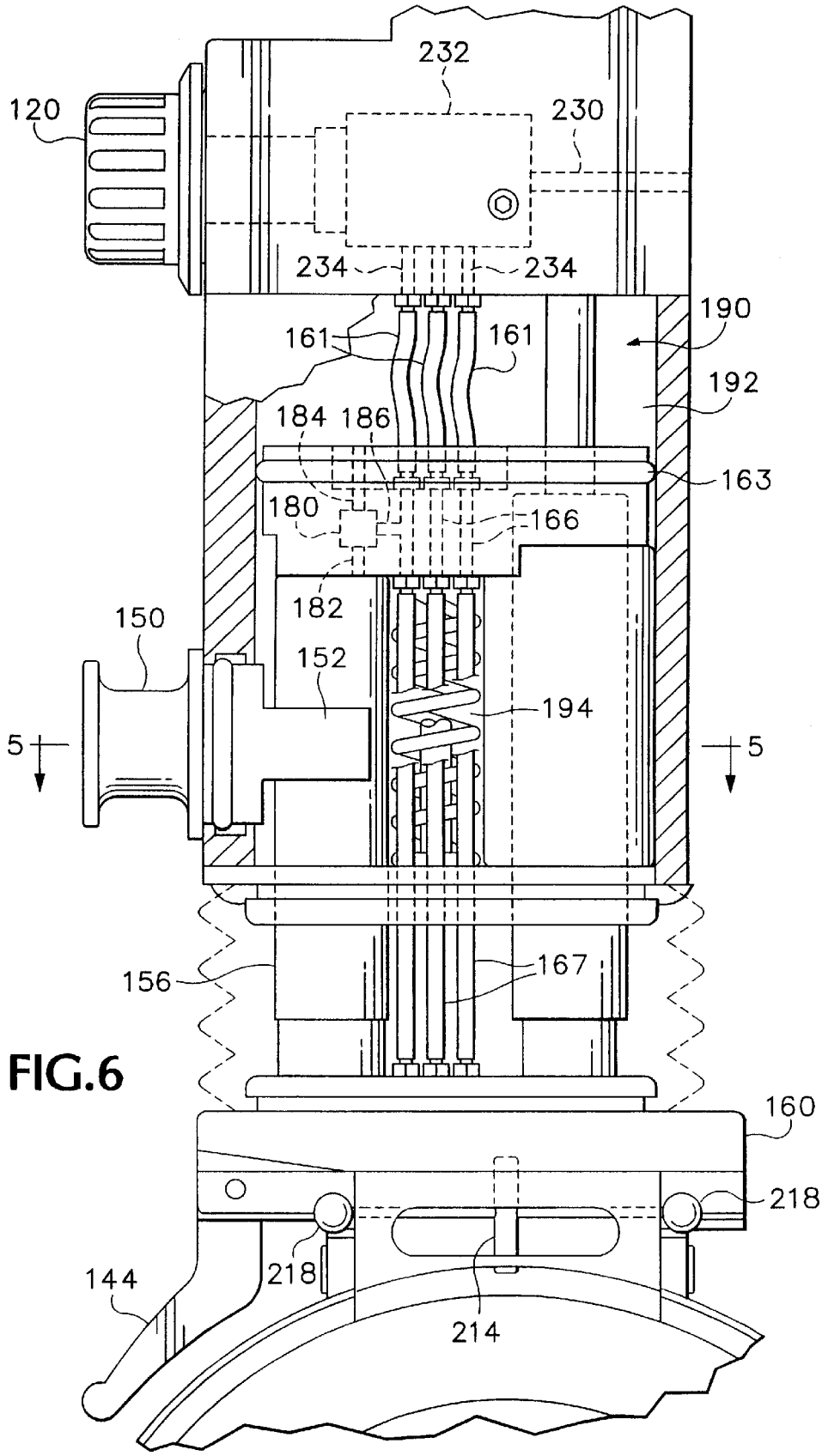
FIG. 6 is a cutaway partial side view of the web slitter of FIG. 3.
Figure 7A:
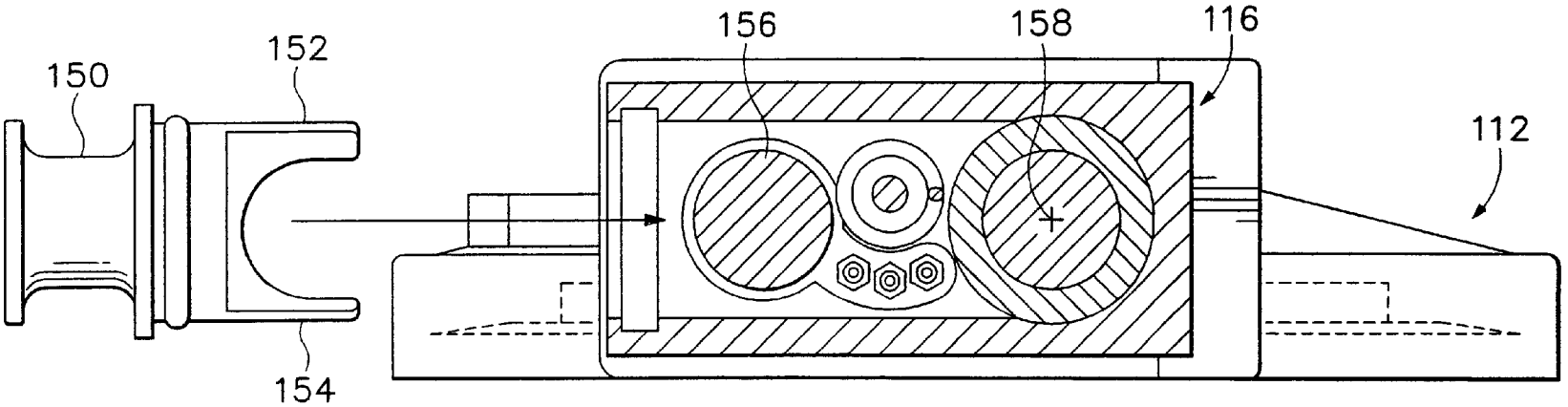
FIG. 7A is a cross-sectional view of the web slitter of FIG. 3, with an adjustment element removed, taken along line 7—7 of FIG. 6.
Figure 7B:
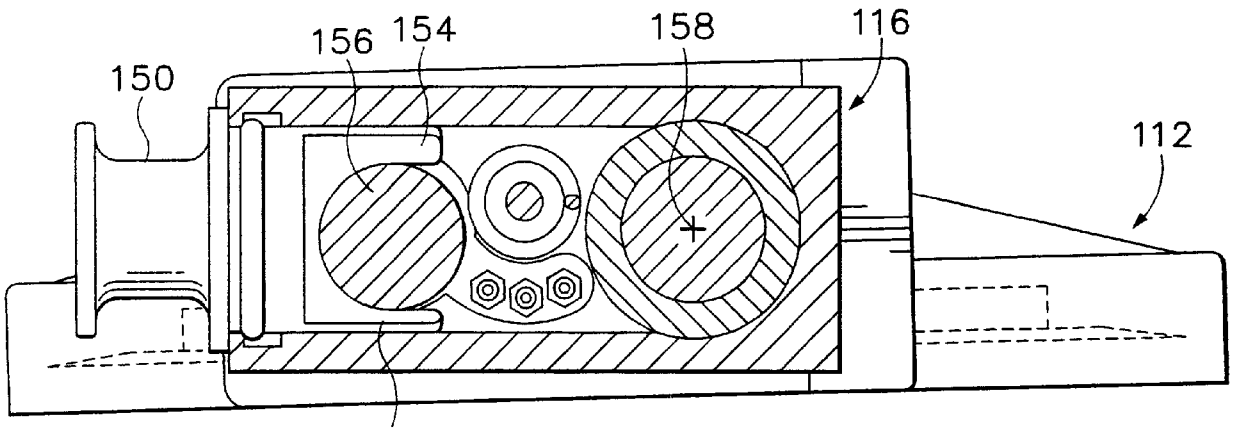
FIG. 7B is a cross-sectional view of the web slitter of FIG. 3, with the adjustment element of FIG. 7A inserted, taken along line 7—7 of FIG. 6.

Accordingly, in a preferred embodiment, a cant angle adjustment assembly including a removable key 150 is provided to facilitate the reconfiguration of the slitting machine. Referring to FIGS. 6, 7A and 7B, the removable key 150 has a thick arm 152 and a thin arm 154 that fit about a guidepost 156 that is internal to the carriage 116. This rotates the blade holder 112 about point 158 (FIGS. 7A and 7B), thereby orienting the blade 122 with a proper cant angle for cutting with a knife 123 that is to its right. The key 150 may be removed, turned over and reinserted so that thick arm 152 is to the right of guide post 156, thereby reorienting the blade 122 for cutting against a knife 123 that is to its left. It should be noted that this adjustment can be made entirely by hand, without the use of any tools. The automatic nature of this adjustment, together with the fact that it can be performed without tools, greatly eases the task of web processing plant personnel.

As noted in the BACKGROUND OF THE INVENTION section, the prior art includes web slitters having a rotatable blade cartridge that attaches to a carriage. In some cases, the rotatable blade cartridge is operatively connected to the carriage by way of a hose or set of hoses extending external to the cartridge and carriage. This configuration has the advantage that the hoses accommodate different piston positions. It has the disadvantage, however, that the hoses must be disconnected and reconnected every time a cartridge is replaced or reoriented by 180°. In addition, the external hoses are subject to damage by operating personnel.

Referring in particular to FIG. 6, the carriage 116 has a pneumatic input port 230 that transmits compressed air to a control assembly 232, which directs the compressed air into one or a combination of carriage resident fluid passageways 234 in dependence on the position of control knob 120. A cylinder 190 houses a piston 163 that divides cylinder 190 into a first chamber 192 and a second chamber 194. A set of three flexible hoses 161 transmit the pneumatic signals of the rest of the fluid passageways 234 to the top of a piston 163 where it is transmitted through a set of first fluid passageways 166 and then through a second set of flexible hoses 167, which extend to carriage-to-blade holder connector 140. A set of three carriage connector fluid passageways 176 extend through connector 140 and terminate at the bottom of connector 140 in a set of openings 172 fitted with gaskets 174 (see FIGS. 10B and 11B.) In turn, the openings 172 mate with a set of blade holder fluid passageways 178 that extend through blade holder 112 and that are plumbed to the blade guard actuator (not shown), the side-shift cylinder and the half-stroke actuator 132, respectively.

The advantages of this system should now be apparent. The two sets of hoses 161 and 167 are safely hidden within carriage 116 and are thereby protected against breakage by operating personnel. In addition, blade holder 112 may be removed from carriage 116 and reattached without the need to detach and reattach any hoses, thereby greatly easing the task of replacing or reorienting a blade holder 112.

Figure 10A:
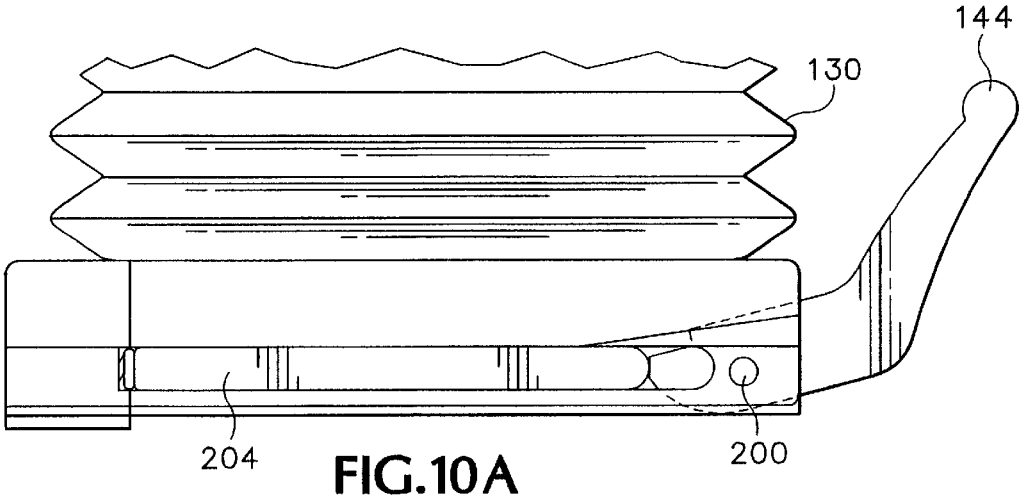
FIG. 10A is a side view of the quick lock and release mechanism of the web slitter of FIG. 3, in its release state.
Figure 10B:
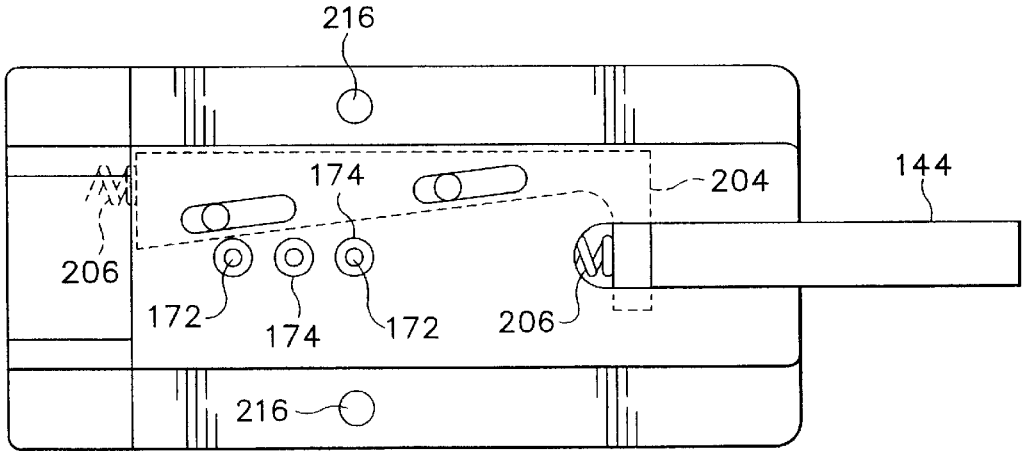
FIG. 10B is a bottom view of the quick release and lock mechanism of FIG. 10A.
Figure 11A:
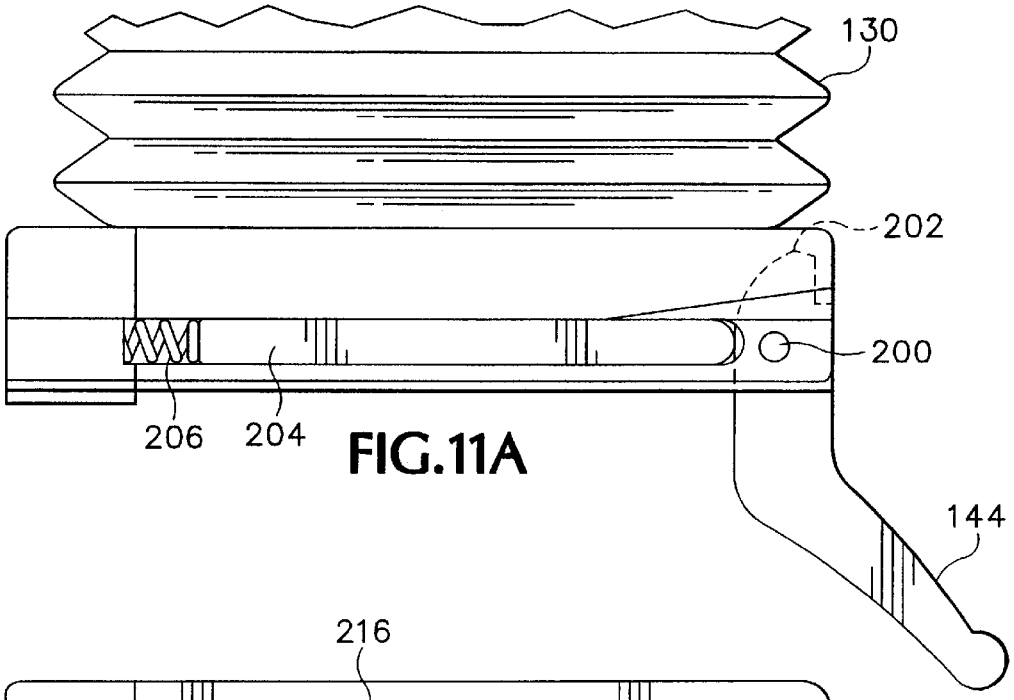
FIG. 11A is a side view of the quick lock and release mechanism of the web slitter, in its lock state.
Figure 11B:
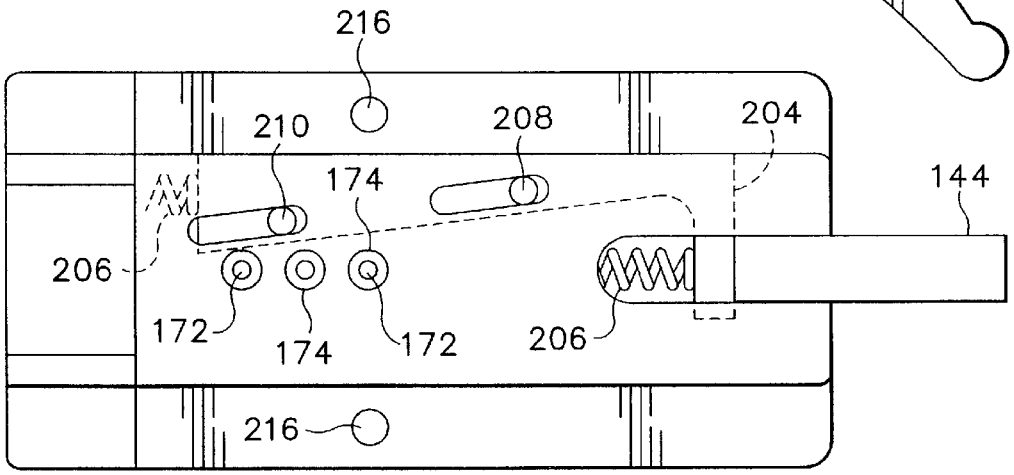
FIG. 11B is a bottom view of the quick lock and release mechanism of FIG. 11A.

As noted previously, the blade holder 112 may be removed from the carriage 116, rotated 180° and reattached. Referring to FIGS. 8, 10*b* and 11*b* there are three carriage connector fluid passageways 176*a*, 176*b* and 176*c* and corresponding openings 172. Two of the three mating blade holder fluid passageways 178*a*, 178*b*, each have two openings. This is so that a first pair of openings of 178*a* and 178*b* can be mated with 176*a* and 176*b* respectively when blade holder 112 is in a first orientation but the other pair of openings of 178*a* and 178*b* can be mated with 176*a* and 176*b* respectively when blade holder 112 is in a second orientation, which is rotated 180° from the first orientation. Accordingly, the blade holder is pneumatically controlled in the exact same manner in either orientation. Fluid passageway 176*c* always mates with the single opening of fluid passageway 178*c*.

As noted in the BACKGROUND OF THE INVENTION section, in prior art systems, air filled with dust or lint would be sucked into the lower chamber defined by the lower side of piston 163, when piston 163 was raised to disengage blade 122 at the end of run mode. In a preferred embodiment of the present invention, this problem is defeated by the addition of a pressurized fluid injection mechanism in the form of a three orifice valve 180, having a lower orifice 182 at the bottom of piston 163, an upper orifice 184, opening at the top of piston 163 and a side orifice 186 opening at the fluid passageway 166 that transmits the side shift cylinder air pressure through piston 163. This valve is so constructed that when the air pressure at orifice 184 falls below the air pressure at side orifice 186, the air pressure from side orifice 186 is shunted to lower orifice 182 and into the second chamber 194. This coincides with the time when air needs to be vented from the side shift cylinder (not shown), so a fortuitous blast of air from side shift cylinder to the bottom chamber 194 both permits the side shift cylinder to shift back and also prevents dust and debris laden air from entering the bottom chamber.

Referring to FIGS. 10A, 10B, 11A, 11B and 12, a blade holder quick lock and release mechanism is shown for locking and releasing the dovetail bar 140 to the bracket 142. A locking bar movement assembly permits an operator to move a locking bar 204 so that it presses and locks against a side of the bracket 142. More specifically, a manual adjustment element in the form of a lever 144 is adapted to be moved about hinge 200 by a human operator, causing cam surface 202 to push back (move to the left in the figures) a locking bar 204 when lever 144 is moved up and permitting a pair of springs 206 to push locking bar 204 forward (to the right in the figures) when lever 144 is moved downwardly. A pair of pins 208 that protrude downwardly from locking bar 204 each fit into a slanted slot 210 in dovetail bar 140. Accordingly, when locking bar is pushed back by cam surface 202, it is also moved inwardly, to release dovetail bar 140 from bracket 142 and permit bracket 142 and thereby blade holder 112 to be slid out from dovetail bar 140. Conversely, when lever 144 is moved downwardly permitting springs 206 to push the locking bar 204 forward, the locking bar 204 is also moved outwardly by way of pins 208 and slots 210, thereby locking dovetail bar 140 into bracket 142.

Figure 12:
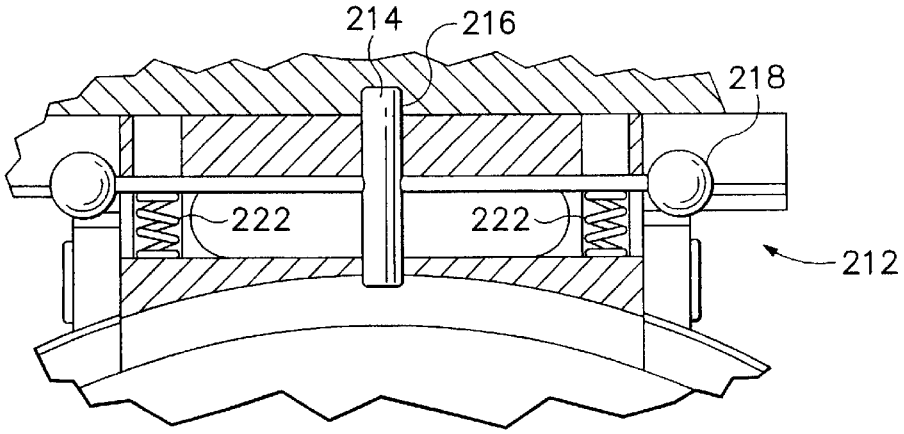
FIG. 12 is a partially sectional side view of the locking pin assembly of the web slitter of FIG. 3.

Referring to FIG. 12, an extra safeguard in the form of a locking pin assembly 212 is included as part of blade holder 112. A locking pin 214 mates with one of a pair of receptive apertures 216 depending on the relative orientation of blade holder 112 and carriage 116. A cross bar 218 is threaded through an aperture (not shown) in locking pin 214 to permit an operator to quickly and easily remove the pin 214 from the receptive aperture 216, thereby permitting blade holder 112 to be removed from carriage 116. A pair of springs 222 urge cross bar 218, and thereby locking pin 214 upwardly, so that an operator must affirmatively pull down on cross bar 218 in order to release blade holder 112.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A web slitter for cutting a continuous web of material, comprising:

(a) a support, (b) a carriage supported by said support and including a fluid pressure control and a first plurality of lines carrying fluid under pressure, (c) a blade holder releaseably coupled to said carriage and enabling selective reversal of said blade holder between opposing orientations on said carriage about a vertical axis, said blade holder including a second plurality of fluid passageways whereby selected ones of said second plurality of fluid passageways align with said first plurality of lines in either of said opposing orientations.

2. A web slitter for cutting a continuous web of material, comprising:

(a) a support;

(b) a blade holder supported by said support and holding a first blade;

(c) a user control input device enabling a user to select at least a run mode or a setup mode alternatively;

(d) a knife adapted to cooperatively engage said blade to cut a web;

(e) a blade positioning assembly operable to move said blade toward engagement with said knife over a horizontal travel distance automatically in response to user selection of said run mode, and to press said blade against said knife with a force variably dependent on said horizontal travel distance, said travel distance being limited to a maximum horizontal travel distance;

(f) said blade positioning assembly being operable, automatically in response to user selection of said setup mode, to move said blade toward said knife over only a predetermined partial portion of said maximum horizontal travel distance.

3. The web slitter of claim 2 wherein said predetermined partial portion is substantially one half of said maximum horizontal travel distance.

4. The web slitter of claim 2, including an actuator automatically activated in response to user selection of said setup mode to block said blade positioning assembly from moving said blade by more than said predetermined partial portion of said maximum horizontal travel distance.

5. A web slitter for cutting a continuous web of material comprising:

(a) a body including a carriage connector, said body having an input port adapted to receive pressurized fluid and at least one first fluid passageway:

(b) a control assembly operable to controllably transmit said pressurized fluid from said input port into said first fluid passageway:

(c) said body having a fluid power cylinder with a piston moveable with respect to said first fluid passageway:

(d) a blade holder moveable by said piston, said blade holder including a blade holder connector matingly and detachably connectable to said carriage connector;

(e) at least one actuator associated with said blade holder operable to be driven by said pressurized fluid, said actuator being moveable in unison with said piston: and (f) at least one second fluid passageway circumventing said piston in a position enclosed by said body and operatively connected to said first fluid passageway, said carriage connector and said blade holder connector defining a further fluid passageway detachably connecting said second fluid passageway operably to said actuator.

6. A web slitter for cutting a continuous web of material, comprising:

(a) a body having an input port adapted to receive pressurized fluid, and at least one first fluid passageway;

(b) a control assembly operable to controllably transmit said pressurized fluid from said input port into said first fluid passageway;

(c) said body having a fluid power cylinder with a piston moveable with respect to said fluid passageway;

(d) a blade holder movable by said piston;

(e) at least one actuator associated with said blade holder operable to be driven by said pressurized fluid, said actuator being movable in unison with said piston;

(f) at least one second fluid passageway circumventing said piston; and (g) said body including a carriage connector, said blade holder including a blade holder connector matingly and detachably connectable to said carriage connector, said carriage connector defining a further fluid passageway detachably connecting said second fluid passageway operably to said actuator.

7. The web slitter of claim 6, said carriage connector and blade holder connector enabling selective reversal of said blade holder between opposing orientations about a vertical axis and defining said further fluid passageway in both of said orientations.

8. A web slitter for cutting a continuous web of material, comprising:

(a) a support;

(b) a carriage supported by said support;

(c) a blade holder releasably and matingly connected to said carriage by a connective assembly enabling selective reversal of said blade holder between opposing orientations on said carriage about a vertical axis; and (d) a blade cant angle adjustment assembly operable to selectively predetermine said opposing orientations of said blade holder by enabling a choice of either a predetermined first blade cant angle or a predetermined second blade cant angle, said first blade cant angle enabling effective web-slitting when said blade holder is connected to said carriage in one of said opposing orientations and said second blade cant angle enabling effective web-slitting when said blade holder is connected to said carriage in the other of said opposing orientations, wherein said blade cant angle adjustment assembly has an opening and a key matingly and removeably insertable into said opening with a first orientation to affect said first blade cant angle and with a second orientation to affect said second blade cant angle.

9. The web slitter of claim 8 wherein said blade cant angle adjustment assembly is mounted on said carriage.

10. The web slitter of claim 8 wherein said blade cant angle adjustment assembly is operable entirely manually.

* * * * *